US009899128B1

(12) United States Patent
Boyer et al.

(10) Patent No.: US 9,899,128 B1
(45) Date of Patent: Feb. 20, 2018

(54) SIGNAL TRANSMISSION CABLE ASSEMBLY WITH UNGROUNDED SHEATH CONTAINING ELECTRICALLY CONDUCTIVE PARTICLES

(71) Applicant: Delphi Technologies, Inc., Troy, MI (US)

(72) Inventors: Richard J. Boyer, Mantua, OH (US); John F. Heffron, Youngstown, OH (US); Evangelia Rubino, Warren, OH (US); Zachary J. Richmond, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 15/413,589

(22) Filed: Jan. 24, 2017

(51) Int. Cl.

| | |
|---|---|
| ***H01B 11/10*** | (2006.01) |
| ***H01B 13/26*** | (2006.01) |
| ***H01B 13/24*** | (2006.01) |
| ***H01B 11/00*** | (2006.01) |
| ***H01B 7/18*** | (2006.01) |
| ***H01B 1/22*** | (2006.01) |
| ***H01B 1/24*** | (2006.01) |

(52) U.S. Cl.
CPC ..... *H01B 11/10* (2013.01); *H01B 1/22* (2013.01); *H01B 1/24* (2013.01); *H01B 7/18* (2013.01); *H01B 7/187* (2013.01); *H01B 11/002* (2013.01); *H01B 13/24* (2013.01); *H01B 13/26* (2013.01)

(58) Field of Classification Search
CPC ..... H01B 11/10; H01B 11/002; H01B 11/02; H01B 1/22; H01B 1/14; H01B 1/16; H01B 1/18; H01B 7/0876; H01B 9/027
See application file for complete search history.

(56) References Cited

U.S. PATENT DOCUMENTS

| | | | | |
|---|---|---|---|---|
| 6,506,492 | B1 * | 1/2003 | Foulger | H01B 1/22 174/110 PM |
| 2005/0029000 | A1 * | 2/2005 | Aisenbrey | H05K 9/0098 174/388 |
| 2010/0212952 | A1 * | 8/2010 | Abdelmoula | H01B 1/026 174/390 |
| 2015/0096782 | A1 * | 4/2015 | Feldmeier | H01B 7/1895 174/102 R |
| 2016/0379735 | A1 * | 12/2016 | Koeppendoerfer | H01B 7/18 174/102 R |

* cited by examiner

*Primary Examiner* — Hoa C Nguyen
*Assistant Examiner* — Amol Patel
(74) *Attorney, Agent, or Firm* — Robert J. Myers

(57) ABSTRACT

A data transmission cable assembly includes an elongate first conductor, an elongate second conductor, and a sheath at least partially axially surrounding the first and second conductors. The sheath contains a plurality of electrically conductive particles interspersed within a matrix formed of an electrically insulative polymeric material. The conductive particles may be formed of a metallic material or and inherently conductive polymer material. The plurality conductive particles may be filaments that form a plurality of electrically interconnected networks. Each network is electrically isolated from every other network. Each network contains less than 125 filaments and/or has a length less than 13 millimeters. The bulk conductivity of the sheath is substantially equal to the conductivity of the electrically insulative polymeric material. The data transmission cable assembly does not include a terminal that is configured to connect the sheath to an electrical ground.

17 Claims, 8 Drawing Sheets

SIGNAL TRANSMISSION CABLE ASSEMBLY WITH UNGROUNDED SHEATH CONTAINING ELECTRICALLY CONDUCTIVE PARTICLES

TECHNICAL FIELD OF THE INVENTION

The invention generally relates to electrical signal transmission cables, and more particularly relates to a signal transmission cable assembly having an ungrounded sheath that contains electrically conductive particles surrounding the signal conductors.

BACKGROUND OF THE INVENTION

The need for higher speed in vehicle data connectivity is increasing. This rapid growth is a result of the demand to have collision avoidance systems, lane departure warning systems, automatic braking systems, adaptive cruise control systems, and pedestrian detection systems incorporated into vehicles to support advanced driver assistance systems (ADAS). ADAS is the first step towards the larger goal of autonomous driving systems.

ADAS relies on many high resolution sensors that convey information to a central control module which compiles the data and decides how to best react to the situation. Due to the large amount of information (data) to be transferred from each high resolution sensor to the control module, data connectivity within the vehicle must be able to transfer the data quickly and reliably. The data connectivity must also be secure, in order to protect the information within the vehicle from outside attack and disruptions by individuals intent on causing malfunctions and damage to the vehicle.

As the ADAS systems within the vehicle become more complex and take responsibility for more control of the vehicle, higher data rates and bandwidth will be required driving the need for more complex data transmission lines.

The most popular form of data transmission line used for in-vehicle data connectivity today and the foreseeable future are cable pairs using differential signaling methods. Unshielded twisted pair (UTP) cables are the most commonly used differential pair cables due to their cost advantage and ability to reliably deliver data between two or more electronic devices. UTP cables are acceptable for lower data rate technologies in the 10 to 20 megabits per second (Mbps) range having a bandwidth in the 5 to 30 megahertz (MHz) range.

Twisted pair (TP) data cables have the unique feature that each line in the pair is intimately interacting electromagnetically with the other line of the pair. This electromagnetic (EM) interaction is not contained to just between the two lines 12,14 in the TP cable, but is about them in a cloud like form E as illustrated in FIG. 1. More detailed depictions of the individual electrical field (e-fields) and magnetic fields (h-fields) are available and are well known to those skilled in the art. FIG. 1 is a simple illustration of the basic concept.

As data rates increase, the containment of the EM cloud becomes even more important. At higher data rates, the use of an insulative jacket 18 surrounding the twisted pair 12, 14 as shown in FIG. 2 is recommended. The jacket 18 is primarily designed to maintain the geometry of the differential pair thereby providing more consistent mutual capacitance between the twisted pair over the length of the cable. This type of cable is commonly referred to as jacketed unshielded twisted pair (J-UTP) cable 10. J-UTP cable 10 is acceptable for certain data transmission protocols usually in the range of 20 to 100 Mbps having a bandwidth in the 30 to 150 MHz range. Jacketing of the cable adds cost to the finished cable.

As illustrated in FIG. 3, if the EM cloud E about the twisted pair 1, 2 is not contained within the jacket 18, interaction of the EM cloud E with the environment surrounding the cable may be induced and can cause signal integrity degradation due to impedance changes and other effects. In addition, data security is also impaired as others could intercept fluctuations in the EM cloud and capture the data that is being transmitted by the TP cable.

For data rates above 100 Mbps having a bandwidth greater than 150 MHz, a metal shield is used about the twisted pair and is known as shielded twisted pair (STP) cable. The STP cable is common in industry but requires that both ends of the shield are connected to an electrical ground. STP cable also requires the use of a shielded connector as the metal shield must contain every section of the TP cable. Since the shield is made of a continuous metal section, both ends must be properly grounded. If the metal shield is not properly grounded, the shield will act as an antenna potentially re-radiating the signals within shield or picking up EMI and coupling the interference to the conductors within the shield. The addition of the shield to the cable and the addition of metal sections to connected componentry drives additional cost and complexity to the finished system.

Ethernet data transmission protocol is being adopted for data transmission in automotive applications. Early automotive systems adopting Ethernet protocol are running at a data rate of 100 Mbps and require data connectivity that supports a bandwidth of at least 100 MHz. As the systems within the vehicle become more complex and take over more control of the vehicle, higher data rates and bandwidth of the connectivity will be required. Investigation into data protocols transmitting at 1000 Mbps having a bandwidth greater than 700 MHz is underway. However, issues are arising regarding the ability to transfer data at this rate and bandwidth in a cost effective way. Complexity of the vehicle harness routing, bundling of cable, external electromagnetic interference (EMI), and signal integrity (SI) are further complicating efforts to produce data signal cables in a cost effective manner.

Parallel wire transmission lines can also be used for data transmission at these rates. Parallel wire transmission lines are often used to reduce manufacturing burden by eliminating the twisting process, but they may not provide enough protection from electromagnetic interference (EMI) and typically require shielding.

Therefore, a cost effective, automotive data signal cable that is capable of transferring data at rates above 100 Mbps having a bandwidth of at least 100 MHz remains desired. The cable must maintain the ability to protect against EMI, and be able to be bundled and routed within a cable harness without affecting signal integrity.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

According to a first embodiment, a data transmission cable assembly is provided. The data transmission cable assembly includes an elongate first conductor, an elongate second conductor, and a sheath that at least partially axially surrounds the first and second conductors. The sheath comprises a plurality of electrically conductive particles that are interspersed within a matrix formed of an electrically insulative polymeric material.

The plurality of conductive particles may be formed of a metallic material. The plurality of conductive particles may be in the form of filaments, e.g. metallic filaments and/or metallically plated fiber filaments, and/or carbon nanotube filaments. The filaments in the sheath are substantially aligned with one another. The filaments form a plurality of electrically interconnected networks, wherein each network is electrically isolated from every other network. Each network contains less than 125 filaments and/or has a length of less than 13 millimeters. The plurality of conductive particles may alternatively or additionally be formed of masses of an inherently conductive polymeric material. The bulk conductivity of the sheath is substantially equal to the conductivity of the electrically insulative polymeric material.

The sheath may be formed over the first and second conductors via an extrusion process or may be in the form of a film wrapped about the first and second conductors. The first and second conductors may twisted one about the other or may be substantially parallel to one another. The data transmission cable assembly may include a plurality of first conductors and a plurality of second conductors. The data transmission cable assembly does not include a terminal configured to connect the sheath to an electrical ground.

The data transmission cable assembly may further include a metallic shield that at least partially axially surrounds the first and second conductors. The sheath axially surrounds this metallic shield. The data transmission cable assembly does not include a terminal that is configured to connect the metallic shield to an electrical ground.

Further features and advantages of the invention will appear more clearly on a reading of the following detailed description of the preferred embodiment of the invention, which is given by way of non-limiting example only and with reference to the accompanying drawings.

BRIEF DESCRIPTION OF THE SEVERAL VIEWS OF THE DRAWING

The present invention will now be described, by way of example with reference to the accompanying drawings, in which.

In these figures, reference numbers having the same last two digits are used to designate identical or similar elements.

DETAILED DESCRIPTION OF THE INVENTION

The inventors have discovered a solution to the problem of the EM cloud extending beyond the exterior of a data cable is an insulative jacket or sheath surrounding the conductors of a twisted pair that includes metallic particles to reduce the EM cloud from the conductors extending beyond the sheath, thereby reducing interaction between the conductors and the surrounding environment. The inventors have observed that the impedance of such a data cable is more consistent along its length and is less subject to variation due to conductive objects near the cable. The sheath does not require a connection to an electrical ground to obtain these benefits.

Figure 4:
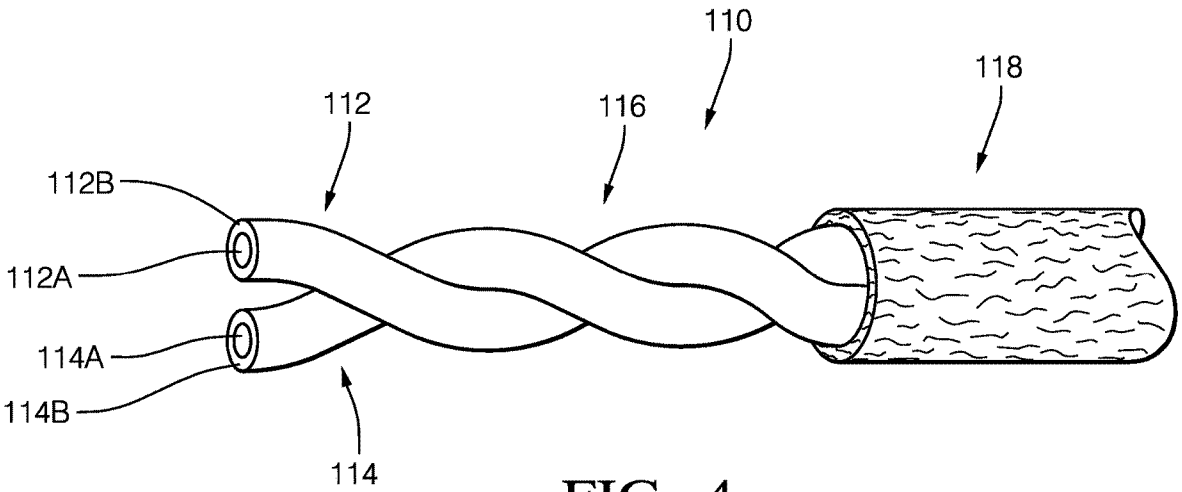
FIG. 4 is a perspective view of a twisted pair cable according to a first embodiment of the invention.

FIG. 4 illustrates a non-limiting example of a data transmission cable assembly, hereinafter referred to as the cable assembly 110. The cable assembly 110 includes a first and second signal conducting wire 112, 114, hereinafter referred to as a twisted pair 116, comprising an elongate first wire conductor 112A surrounded by a first insulative layer 112B and an elongate second wire conductor 114A surrounded by a second insulative layer 114B. The first and second signal conducting wires 112, 114 are twisted one about the other, preferably having a consistent lay length and twist angle. The materials and methods used to produce a twisted wire pair are well known to those skilled in the art.

Figure 5:
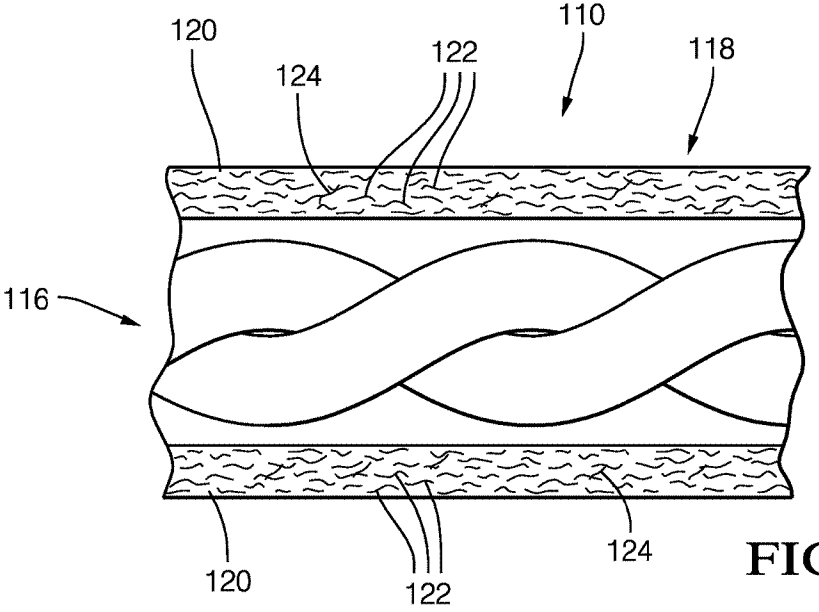
FIG. 5 is a cut-away side view of the twisted pair cable of FIG. 4 according to the first embodiment of the invention.

The cable assembly 110 further includes a sheath 118 that surrounds the twisted pair 116 along the longitudinal axis L of the cable assembly 110, except for the portion that is removed to terminate the conductors 112A, 114A. As illustrated in FIG. 5, the sheath 118 is formed of a dielectric polymeric material 120, such as a thermoplastics or thermoset polymer and includes a plurality of electrically conductive particles 122 that may include, but are not limited to, metal powders, metal fibers, metal plated fibers, carbon nanotubes, and inherently conductive polymers, that are interspersed within a matrix formed of the dielectric polymeric material 120. The conductive particles 122 are dispersed within the polymeric matrix 120 such that the bulk conductivity of the sheath 118 is substantially equal to the conductivity of the electrically insulative polymeric material 120. As used herein, substantially equal means the conductivity values are within ±10%.

As illustrated in FIG. 5, the conductive particles 122 are in the form of conductive filaments 122, e.g. metallic filaments and/or metallically plated fiber filaments, and/or carbon nanotube filaments. The sheath 118 is applied over the twisted pair 116 using a plastic extrusion process. The conductive filaments 122 in the sheath 118 are substantially aligned with one another which has been observed to occur during extrusion of filaments in a polymer matrix. The conductive filaments 122 contact each other to form a plurality of electrically interconnected networks. However, due to the alignment of the conductive filaments 122 in the flow direction of the extrusion and the concentration of particles in the matrix, the conductive filaments 122 form small, isolated filament networks 124 that contains less than 125 filaments and/or have a length of less than 13 millimeters. Because the filament networks 124 are isolated, they cannot effectively connect electricity through the sheath 118 and conductivity of the sheath 118 is substantially equal to the conductivity of the electrically insulative polymeric material 120. The sheath may preferably contain 5 to 50 layers of conductive filaments 122 between the twisted pair 116 and the outer surface of the sheath.

Extruding a polymeric material containing particles produces a skin layer on the outer surface of the extrusion that has a much lower concentration of the particles than the internal portion of the extrusion. Since this skin layer is rich in the dielectric polymeric material 120, the sheath 118 may also provide an electrical insulator for the cable assembly 110.

Figure 6:
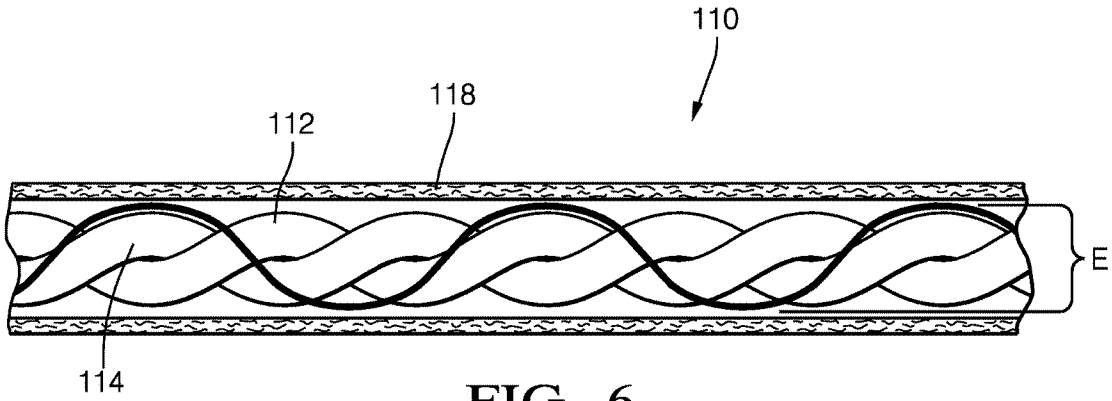
FIG. 6 is a schematic cut-away side view of an EM field in the twisted pair cable of FIG. 4 according to the first embodiment of the invention.

Without subscribing to any particular theory of operation, the conductive particles 122 in the sheath 118 increase the dielectric constant value of the sheath so that it is higher than the dielectric constant of the base dielectric material 120 causing the sheath 118 to absorb and reflect the EM cloud E from the twisted pair 116 so that the EM cloud E is substantially continued within the sheath 118 as illustrated in FIG. 6. Therefore, it is not necessary to connect the sheath 118 to ground to avoid radiation of the EM cloud E from the cable assembly 110.

The sheath 118 does not provide all of the advantages of a full metal shield regarding EMI, but the sheath 118 has demonstrated that adequate shielding effectiveness for use in cable assemblies 110 for differential signaling. The electromagnetic behavior of several types of differential signaling protocols (e.g. USB 2.0, Ethernet protocol) were examined and a the cable assembly 110 was shown to contain the necessary EM cloud E and prevent interference and/or interception by known EMI threats. Based on the required extent of shielding needed to be provided by the sheath 118, the conductive particle content in the polymeric material 120 of the sheath 118 can be adjusted to produce the most cost effective solution.

Figure 1:
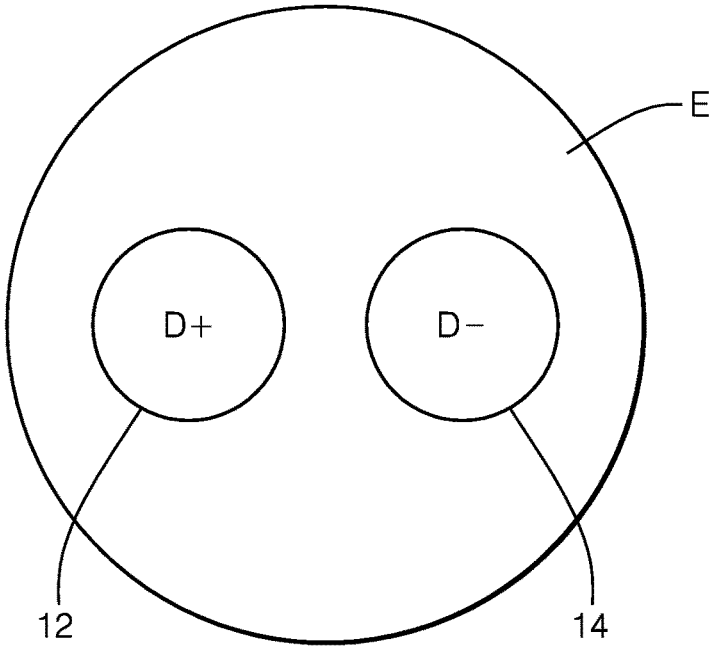
FIG. 1 is a schematic view of an electromagnetic (EM) field (cloud) around a pair of conductors using differential signaling methods.
Figure 2:
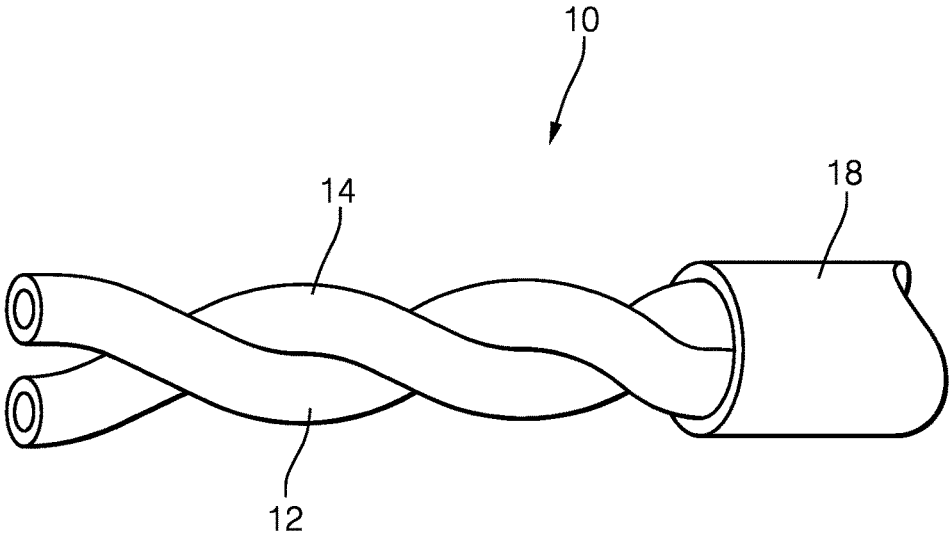
PRIOR ART FIG. 2
FIG. 2 is a perspective view of a jacketed unshielded twisted pair (J-UTP) cable according to the prior art.
Figure 3:
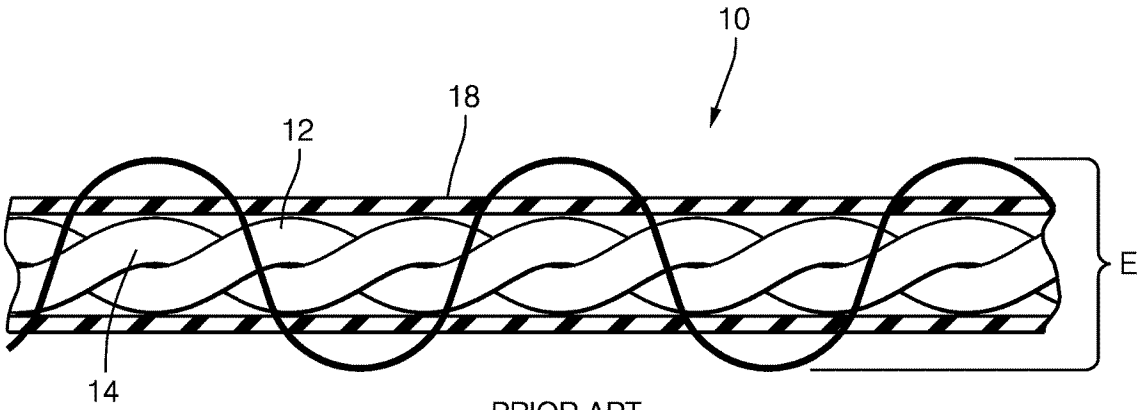
PRIOR ART FIG. 3
FIG. 3 is a schematic cut-away side view of an EM field around the J-UTP cable of FIG. 2 according to the prior art.

Differential pairs may be designed for use in a J-UTP cable 10 (as shown in FIG. 2) by over designing the characteristic impedance required for a specific data transmission protocol. When the jacket 18 is applied to the J-UTP cable 10, the characteristic impedance is brought into range and meets specified requirements. This design consideration is due to the effect that the jacket 18 has on the EM cloud E about the twisted pair 12, 14. Similar design consideration are also used for STP cables.

Considerations regarding characteristic impedance must also be taken into account when configuring the composition of the sheath 118. By knowing the exact composition of the conductive particles 122 and polymeric material 120 in the sheath 118, the characteristics of the sheath 118 and the transmission line within the sheath 118 can be optimized for a desired characteristic impedance.

Design parameters of twisted pairs used for differential signaling are well known to those skilled in the art and are based on the materials and geometries applied. When designing the sheath 118, the unique properties of the polymer/metallic composite material must be taken into account and applied to these standard equations.

Comparative tests of the cable assembly 110 versus a standard J-UTP cable 10 were performed and the testing procedures and results are discussed below.

Figure 7:
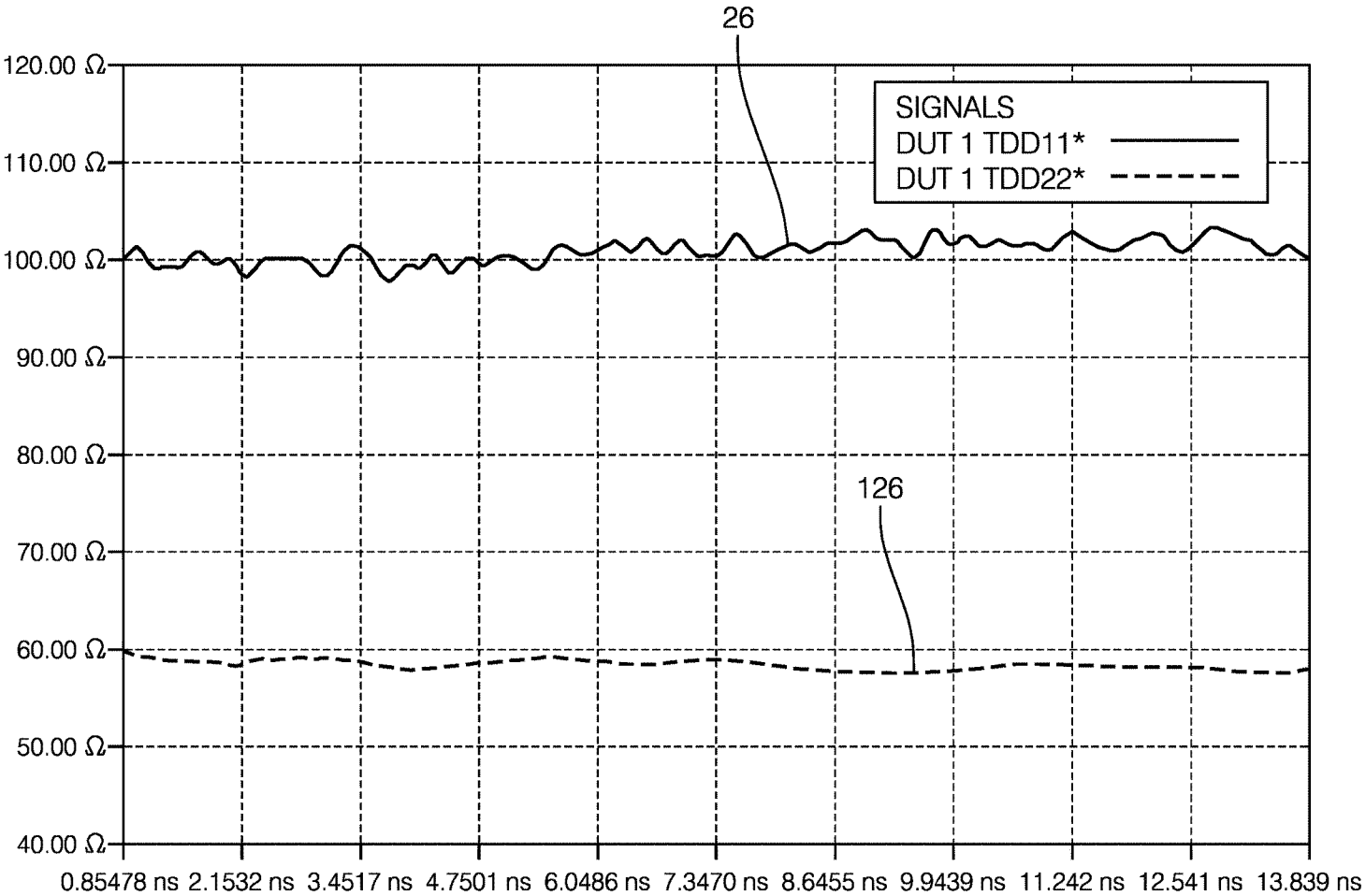
FIG. 7 is a graph comparing impedance performance of the J-UTP cable of FIG. 2 to the twisted pair cable of FIG. 4.
Figure 8:
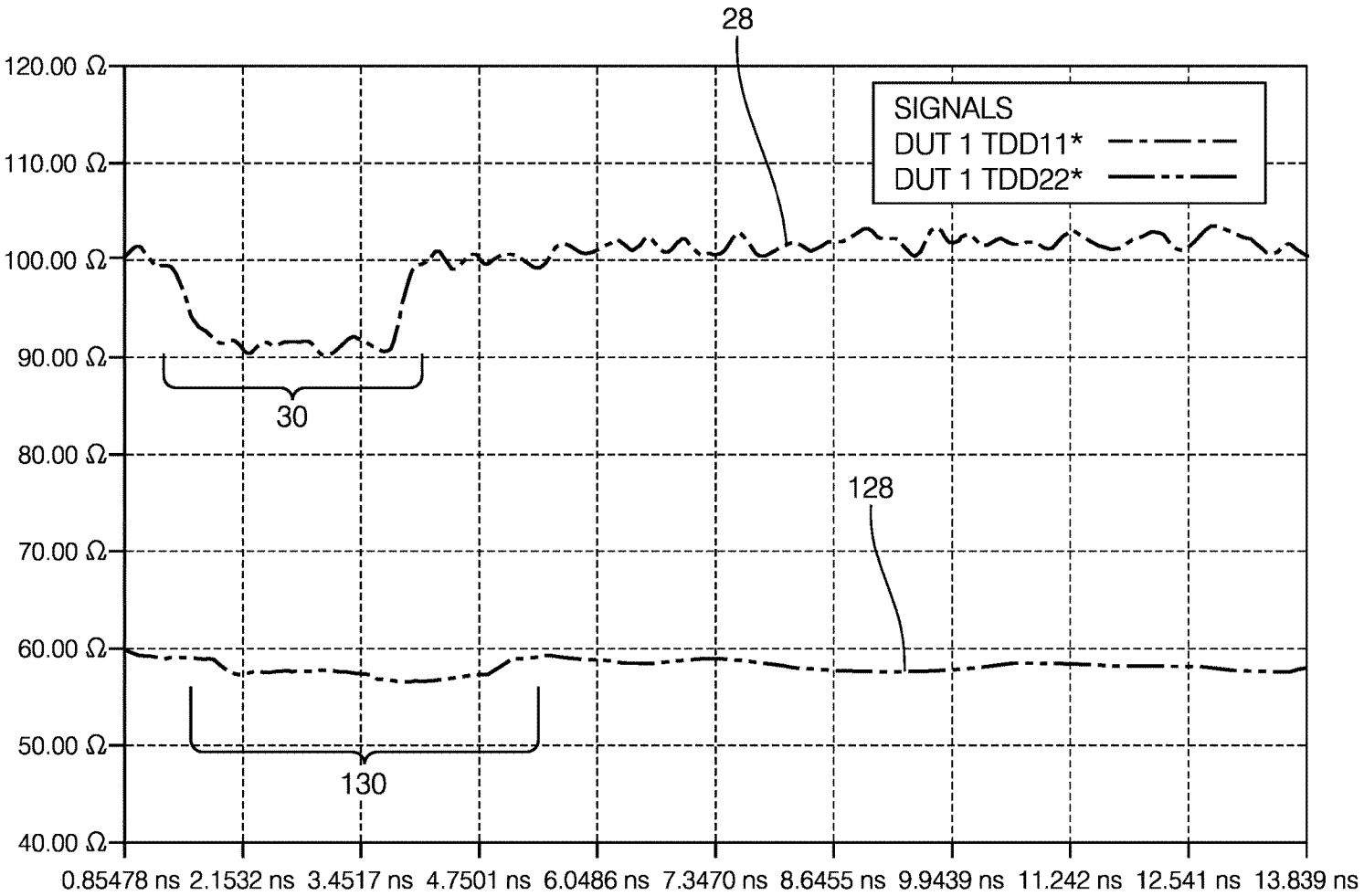
FIG. 8 is a graph comparing impedance performance of the J-UTP cable of FIG. 2 to the twisted pair cable of FIG. 4 when in contact with an external conductor.
Figure 9:
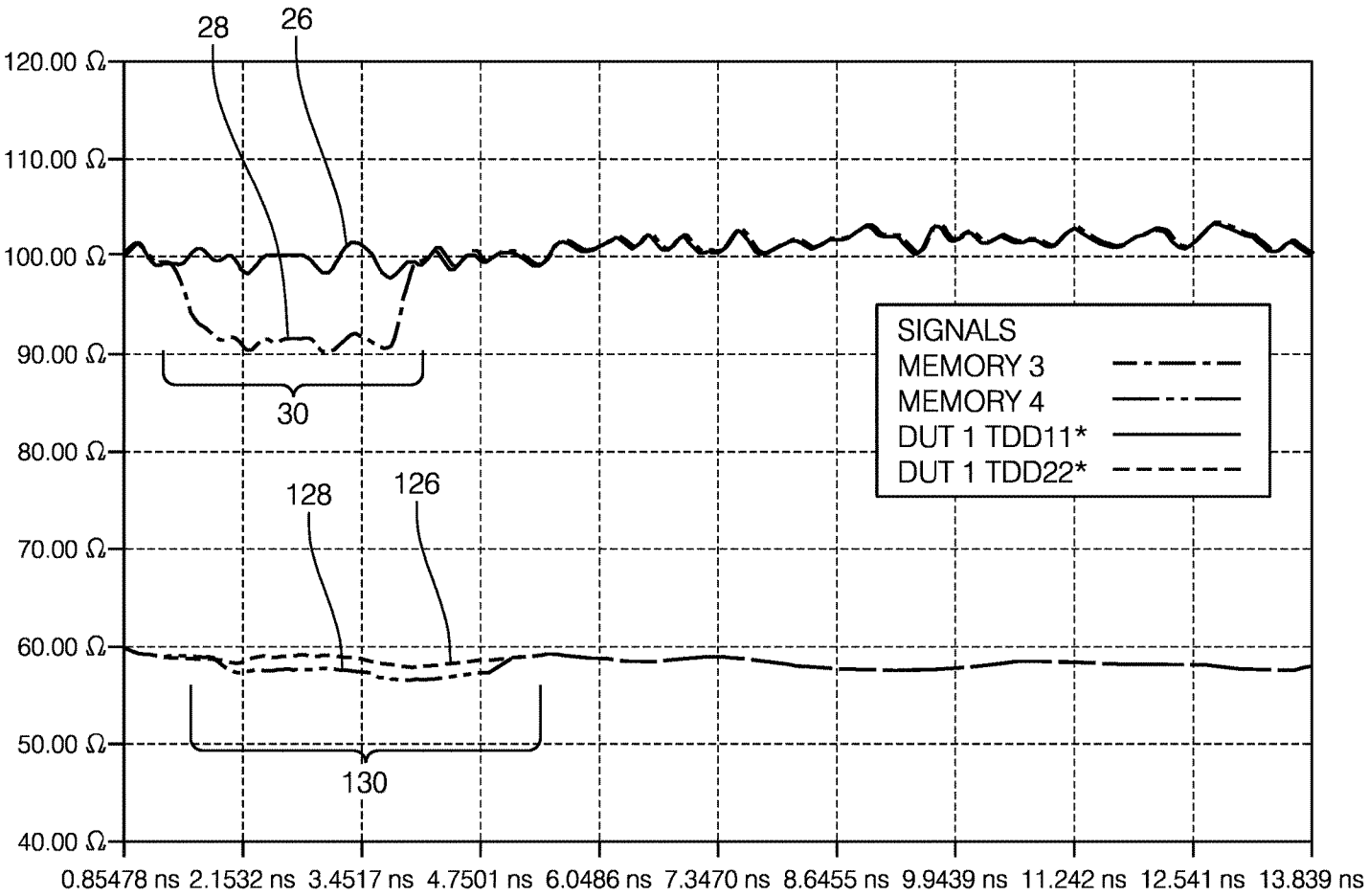
FIG. 9 is an overlay of the graph of FIG. 7 and the graph of FIG. 8 to better illustrate the differences between the two.

Two identical lengths of cable were prepared, the first a length of J-UTP cable having a characteristic impendence of about 100Ω and the second a length of the cable assembly 110 having a characteristic impedance of about 60Ω. The impedance along the cable was then measured using a time domain reflectometer. FIG. 7 shows a plot of the impedance 26 along the J-UTP cable 10 and the impedance 126 along the cable assembly 110. As can be seen in FIG. 7 the variation in impedance 126 along the length of the cable assembly 110 is less than the variation in impedance 26 along the length of the J-UTP cable 10. A length of copper tape was then applied to the external surface of the J-UTP cable 10 and the cable assembly 110. This copper tape was used to simulate the effect of an external connective surface, such a vehicle body panel, on the cable impedance. FIG. 8 shows a plot of the impedance 28 along the modified J-UTP cable 10 and the impedance 128 along the modified cable assembly 110. As can be seen in FIG. 8 the modified J-UTP cable 10 experienced variation in impedance 28 of about 10% along the portion of the cable 30 where the copper tape was applied while the modified cable assembly 110 experienced variation in impendence 128 of only about 4% along the portion of the cable 130 where the copper tape was applied. FIG. 9 shows an overlay of the graphs of FIGS. 7 and 8 so that the differences in impedance can be seen more easily.

Figure 10:
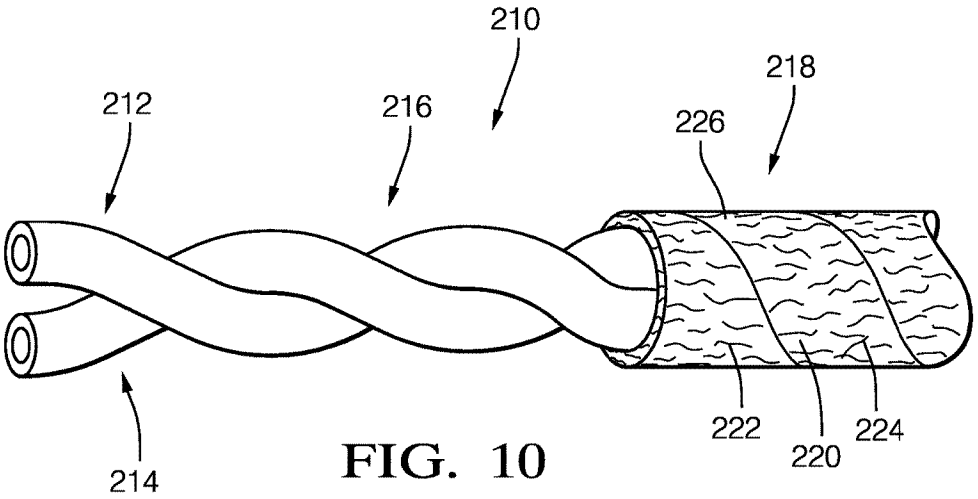
FIG. 10 is a perspective view of a twisted pair cable according to a second embodiment of the invention.

FIG. 10 illustrates an alternative embodiment of the cable assembly 210 in which the sheath 218 is formed by an extruded film or tape 226 formed of a dielectric polymeric material 220 that contains conductive filaments 222 that is wrapped about the twisted pair 216. The extrusion of the tape 226 substantially aligns the conductive filaments 222 with one another as described above. However, due to the alignment of the conductive filaments 222 in the flow direction of the extrusion and the concentration of conductive particles 222 in the matrix of dielectric polymeric material 220, the conductive filaments 222 form small, isolated networks 224 that contains less than 125 conductive filaments 222 and/or have a length of less than 13 millimeters. Because the filament networks 224 are isolated from one another, they cannot effectively connect electricity through the sheath 118 and conductivity of the sheath 218 is substantially equal to the conductivity of the dielectric polymeric material 220. The tape 226 may be spirally wrapped about the twisted pair 216 or longitudinally (cigarette) wrapped about the twisted pair 216. The film 226 may also be an extruded tube that is vacuum or heat shrunk over the twisted pair 216. Extruding a polymeric material containing particles into a film produces a skin layer on the outer surface of the film that has a much lower concentration of the particles than the internal portion of the film. Since this skin layer is rich in the dielectric polymeric material 120, the tape of the sheath 118 may also provide an electrical insulator for the cable assembly 110.

Due to the loading of the EM cloud by the metallic particles in the sheath 118, the cable assembly 110 may have greater signal loss per length than other twisted pair cable types, e.g. J-UTP cables 10. However, since most automotive applications have a cable length of 7 meters or less, the cable assembly 110 can still provide reliable data communication because the signal loss will not be significant over those distances.

Figure 11:
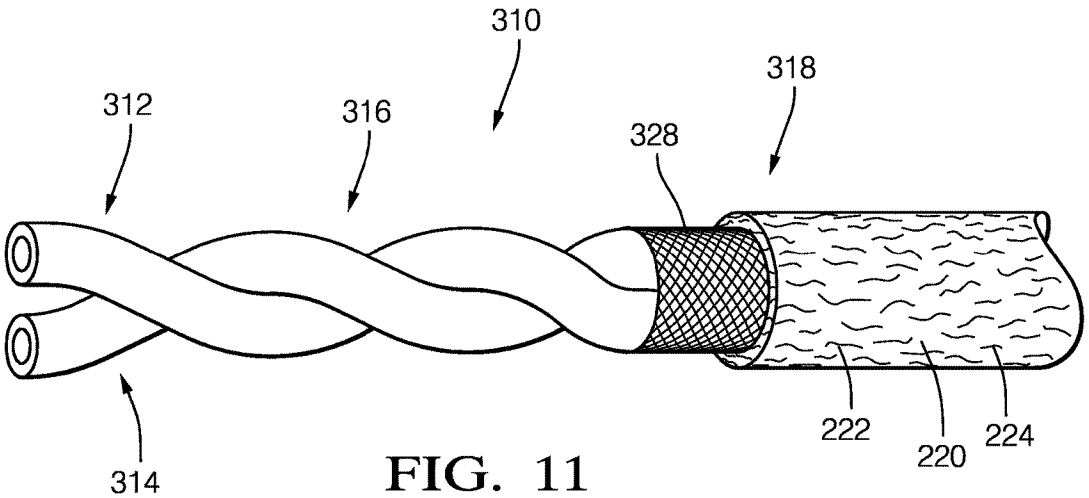
FIG. 11 is a perspective view of a twisted pair cable according to a third embodiment of the invention.

In order to reduce losses in the cable, an alternative embodiment of the cable assembly 310 shown in FIG. 11 includes a metallic shield 328 that that surrounds the twisted pair 316 along the longitudinal axis L of the cable assembly 310, except for the portion that is removed to terminate the signal wires 312, 314. The metallic shield 328 may be a braided shield formed of a plurality of woven conductors, such as copper or tin plated copper or a foil shield formed of a flexible conductive material, such as aluminized biaxially oriented PET film. Biaxially oriented polyethylene terephthalate film is commonly known by the trade name MYLAR. The design and construction of braided and foil shields are well known to those skilled in the art. A sheath 318 formed of a polymeric material 320 containing conductive particles 322 as described above surrounds this metallic shield along the longitudinal axis L of the cable assembly 310, except for the portion that is removed to terminate the conductors 312A, 314A. This cable assembly 310 does not include a terminal that is configured to connect the sheath 318 or the metallic shield 328 to an electrical ground.

While the illustrated examples presented herein show a cable assembly having a single twisted pair, alternative embodiments of the invention may be envisioned that have multiple twisted pairs.

Figure 12:
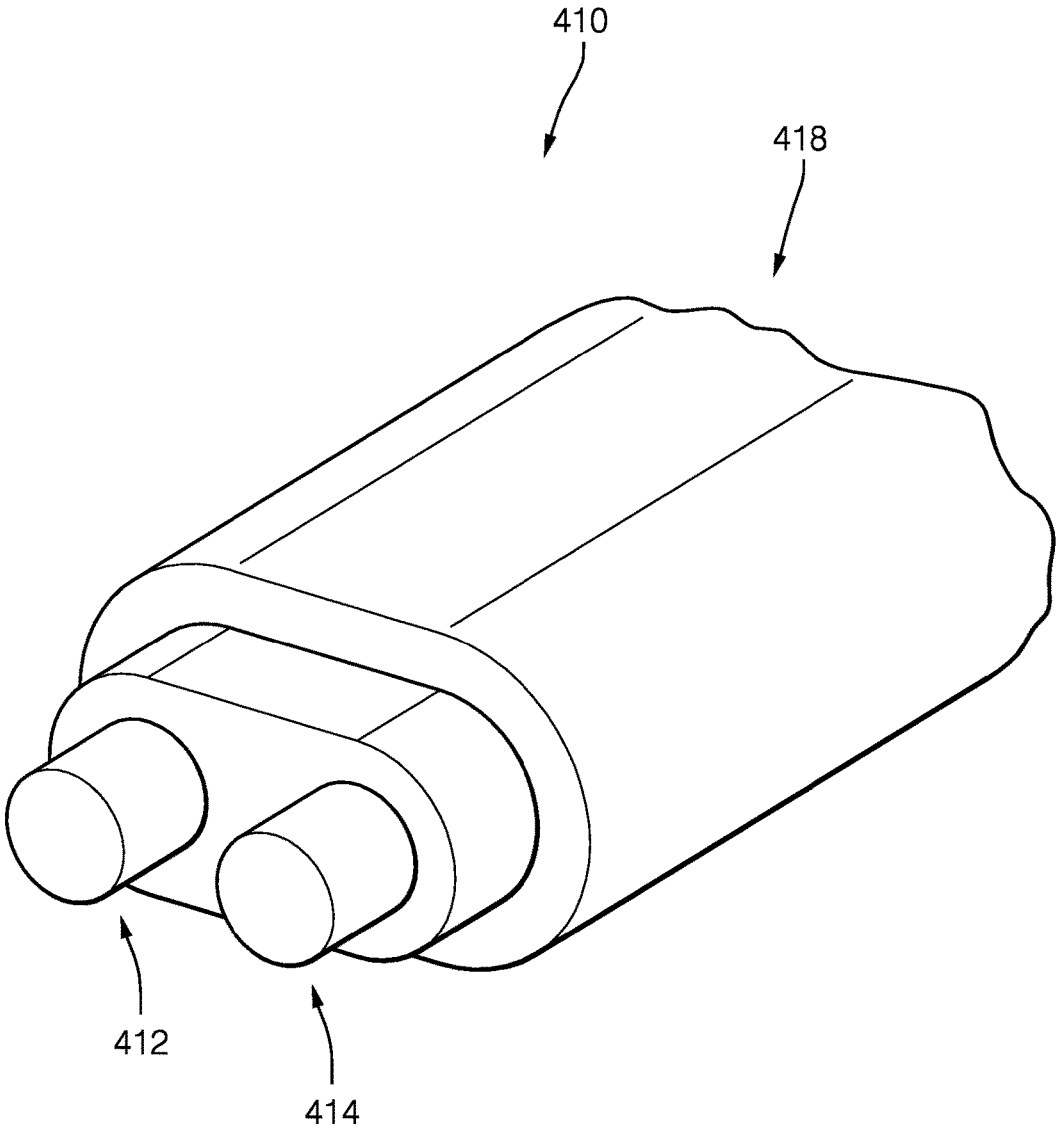
FIG. 12 is a perspective view of a twisted pair cable according to a second embodiment of the invention.

Another alternative embodiment of cable assembly 410 is shown in FIG. 12. According to this embodiment, the pair of signal transmitting wires 412, 414 are substantially parallel to one another rather than twisted and are surrounded by a sheath 418 formed of a polymeric material containing conductive particles as described above.

Accordingly, a data transmission cable assembly is presented. The cable assembly 110 provides an alternate method of containing the EM cloud E about the signal wires 112, 114 and does not require a traditional, continuous metal shield. The sheath 118 of the cable assembly 110 does not require a connection to an electrical ground, simplifying the termination of the cable assembly 110 and thus reducing manufacturing costs. The EM energy flow E is controlled through the differential pair by the conductive particles 122 contained in the sheath 118. This sheath 118 has been shown to provide shielding effects and enables an increase in system bandwidth as compared to a J-UTP cable 10 by:

a. improving immunity and emissions EMC performance;
b. reducing impedance change of the twisted pair 116 due to routing and external structures; and
c. enhancing signal integrity performance and reducing mode conversion.

The sheath 118 is an integral part of the cable assembly 110 not just an electromagnetic shield, but is also a means of determining characteristic impedance, capacitance and loss of the cable assembly 110. The sheath 118 enhances the design freedom of cable assembly parameters.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. A data transmission cable assembly, comprising:
an elongate first conductor;
an elongate second conductor; and
a sheath providing an outer surface of the data transmission cable assembly and at least partially axially surrounding the first and second conductors, wherein said sheath comprises a plurality of electrically conductive particles interspersed within a matrix formed of an electrically insulative polymeric material, wherein the bulk conductivity of the sheath is substantially equal to the conductivity of the electrically insulative polymeric material, and wherein the outer surface has a lower concentration of the electrically conductive particles than an internal portion of the sheath.

2. The data transmission cable assembly according to claim 1, wherein the plurality of conductive particles are formed of a metallic material.

3. The data transmission cable assembly according to claim 2, wherein the plurality of conductive particles are in the form of filaments.

4. The data transmission cable assembly according to claim 3, wherein the filaments are metallic filaments.

5. The data transmission cable assembly according to claim 3, wherein the filaments are metallically plated fiber filaments.

6. The data transmission cable assembly according to claim 3, wherein the filaments are carbon nanotube filaments.

7. The data transmission cable assembly according to claim 3, wherein the filaments are substantially aligned with one another.

8. The data transmission cable assembly according to claim 3, wherein the filaments form a plurality of electrically interconnected networks, wherein each network is electrically isolated from every other network, and wherein each network contains less than 125 filaments.

9. The data transmission cable assembly according to claim 3, wherein the filaments form a plurality of electrically interconnected networks, wherein each network is electrically isolated from every other network, and wherein each network has a length of less than 13 millimeters.

10. The data transmission cable assembly according to claim 1, wherein the plurality of conductive particles are formed of an inherently conductive polymeric material.

11. The data transmission cable assembly according to claim 1, wherein the sheath is formed via an extrusion process.

12. The data transmission cable assembly according to claim 1, wherein the sheath is in the form of a film wrapped about the first and second conductors.

13. The data transmission cable assembly according to claim 1, wherein the first and second conductors are twisted one about the other.

14. The data transmission cable assembly according to claim 1, wherein the first and second conductors are substantially parallel to one another.

15. The data transmission cable assembly according to claim 1, wherein the assembly does not include a terminal configured to connect the sheath to an electrical ground.

16. The data transmission cable assembly according to claim 1, wherein the assembly comprises a plurality of first conductors and a plurality of second conductors.

17. The data transmission cable assembly according to claim 1, further comprising a metallic shield at least partially axially surrounding the first and second conductors, wherein the sheath axially surrounds the metallic shield.

* * * * *